US007160129B2

(12) United States Patent
Yin

(10) Patent No.: US 7,160,129 B2
(45) Date of Patent: Jan. 9, 2007

(54) MEMORY CARD CONNECTOR WITH HINGED COVER

(75) Inventor: Hongjung Yin, Xukangli Wuxi (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/183,065

(22) Filed: Jul. 15, 2005

(65) Prior Publication Data

US 2006/0014437 A1 Jan. 19, 2006

(30) Foreign Application Priority Data

Jul. 16, 2004 (CN) ..... 2004 2 0084317 U

(51) Int. Cl.
*H01R 13/62* (2006.01)

(52) U.S. Cl. ..... 439/331; 439/326

(58) Field of Classification Search ..... 439/331, 439/326, 325, 328, 330; 39/331, 330, 326, 39/328, 325
See application file for complete search history.

(56) References Cited

U.S. PATENT DOCUMENTS 6,024,593 A * 2/2000 Hyland ..... 439/326
6,368,138 B1 * 4/2002 Huang ..... 439/331
6,884,102 B1 * 4/2005 Rumpel et al. ..... 439/331
6,890,203 B1 * 5/2005 Matsunaga et al. ..... 439/331

* cited by examiner

*Primary Examiner*—Phuong Dinh

(57) ABSTRACT

A memory card connector is provided for receiving a memory card having a plurality of conductive contacts. An insulative housing mounts a plurality of conductive terminals. A metal cover has a receptacle for receiving the memory card. A pivot mechanism is operatively associated between the cover and the housing to mount the cover for pivotal movement between an open position to allow the memory card to be received on the cover and a closed position bringing the contacts of the memory card into engagement with the terminals on the housing. The pivot mechanism includes a mounting portion at one end of the housing and a pivot projection at one end of the cover. A metal bracket is disposed about the mounting portion and includes a pivot socket for receiving the pivot projection.

16 Claims, 7 Drawing Sheets

MEMORY CARD CONNECTOR WITH HINGED COVER

FIELD OF THE INVENTION

This invention generally relates to the art of electrical connectors and, particularly, to a memory card connector having a hinged cover.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smartphones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card, itself, writes or reads via the connector and can transmit between electrical appliances, such as a word processor, personal computer, personal data assistant or the like. The card may be used in applications such as mobile or cellular telephones which are actuated and permit data access after identifying an identification code stored on a SIM (subscriber identification module) card. The SIM card has a conductive face with an array of contacts, and the mobile phone has a SIM card connector with terminals for electrical connection with the contacts of the SIM card to ensure the subscriber identification confirmation.

FIGS. 1(*a*) and 1(*b*) show a prior art memory or SIM card connector, generally designated 10, as might be seen in U.S. Pat. No. 5,996,891. The connector includes an insulative or plastic housing 12 which mounts a plurality of conductive terminals having contact portions 14 projecting upwardly from the housing. A metal cover 16 is pivotally mounted on the housing for pivotal movement between an open position shown in FIG. 1(*a*) to allow a memory or SIM card to be inserted into the cover, and a closed and latched position shown in FIG. 1(*b*) whereat contacts of the memory card are brought into engagement with the contact portions 14 of the terminals on the housing. The housing has a pair of mounting portions 12(*a*) at one end thereof. The outside face of each mounting portion 12*a* is provided with a two-part pivot socket which includes a pivot recess 18*a*, a latch recess 18*b* and a detent ridge 18*c* therebetween. Metal cover 16 has a pair of spring arms 16*a* at opposite sides thereof, with each spring arm formed with an inwardly projecting pivot projection 20.

In the operation of prior art connector 10, metal cover 16 is pivoted to its open position shown in FIG. 1(*a*) and a SIM card is inserted or mounted within the underside of the cover. The cover and SIM card then are pivoted downwardly to a closed position, with pivot projections 20 disposed within pivot recesses 18*a*. This brings the contacts on the SIM card into engagement with contact portions 14 of the terminals mounted on housing 12. The cover then is slidingly moved in the direction of arrow "A" (FIG. 1(*b*) ) as pivot projections 20 move over detent ridges 18*c* and into latch recesses 18*b*. The detent ridges create an audible and/or tactile indication that the cover has moved from its closed position to its latched position whereat appropriate latch means, such as at 22, prevent the cover from pivoting back upwardly away from its latch position.

Although SIM card connectors 10 of the prior art may be satisfactory for some purposes, because of the metal-on-plastic interengagement of the metal cover and the plastic housing at the pivot area therebetween, considerable wearing or deterioration of the plastic occurs after the connector is subjected to repeated opening and closing of the cover relative to the housing. The pivot connections between the cover and the housing become loose, and the cover is easily displaced from the housing, particularly if the connector is subjected to shock, such as dropping a mobile telephone onto the ground. The present invention is directed to solving these problems by providing an improved pivot connection between the cover and the housing of such connectors.

SUMMARY OF THE INVENTION

An object, therefore, of the invention is to provide a new and improved memory card connector of the character described.

In the exemplary embodiment of the invention, the memory card connector receives a memory card having a plurality of conductive contacts. An insulative housing mounts a plurality of conductive terminals. A metal cover has receptacle means for receiving the memory card. Pivot means are operatively associated between the cover and the housing to mount the cover for pivotal movement between an open position to allow the memory card to be received on the cover and a closed position bringing the contacts of the memory card into engagement with the terminals on the housing. The pivot means include a mounting portion at one end of the housing and a pivot projection at one end of the cover. A metal bracket is disposed about the mounting portion and includes a pivot socket for receiving the pivot projection.

According to one aspect of the invention, the bracket is stamped and formed of sheet metal material and includes a wall having the pivot socket therein. The wall is juxtaposed over a side of the mounting portion of the housing. As disclosed herein, the mounting portion has a pivot recess behind the pivot socket in the wall of the bracket. In the preferred embodiment, the mounting portion of the housing is formed by a mounting arm projecting from the housing. The metal bracket includes a pair of side walls juxtaposed over opposite sides of the mounting arm, with both side walls including a pivot socket. The metal cover includes a pair of opposing pivot projections for positioning in the pair of pivot sockets.

At least one of the pivot sockets includes a pivot portion and a latch portion to allow the cover to slidably move from the closed position to a latched position. In one embodiment of the invention, the latch portion of the pivot socket is conFIG.d to prevent the cover from pivoting relative to the housing when the cover is in its latched position.

Finally, in the preferred embodiment, the housing includes a pair of the mounting portions at opposite sides of one end thereof. The cover includes a pair of spring arms at one end thereof juxtaposed alongside the pair of mounting portions and having pivot projections thereon. A pair of the metal brackets are disposed about the pair of mounting portions and include pivot sockets for receiving the pivot projections of the pair of spring arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1A:
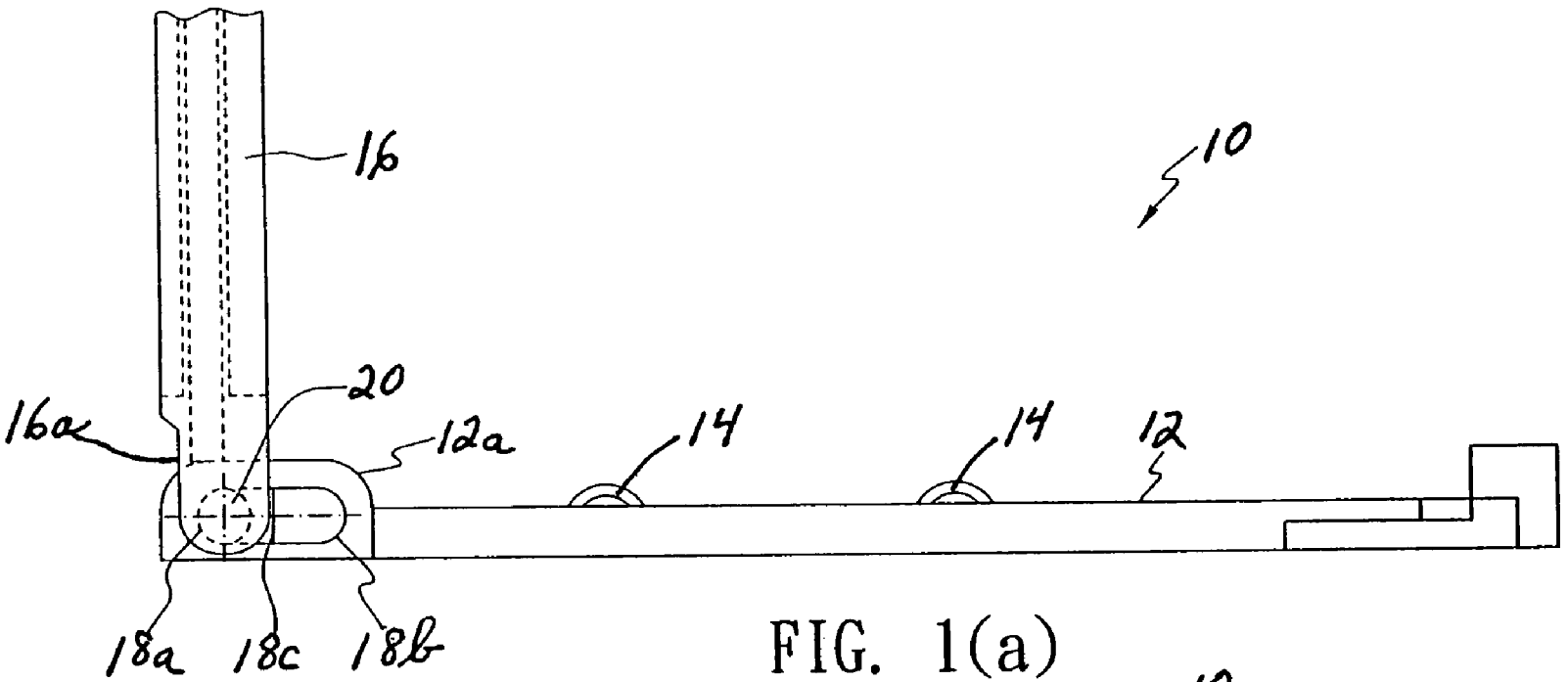
FIGS. 1(*a*) and 1(*b*) are side elevational views of a memory card connector according to the prior art and described in the Background, above.
Figure 1B:
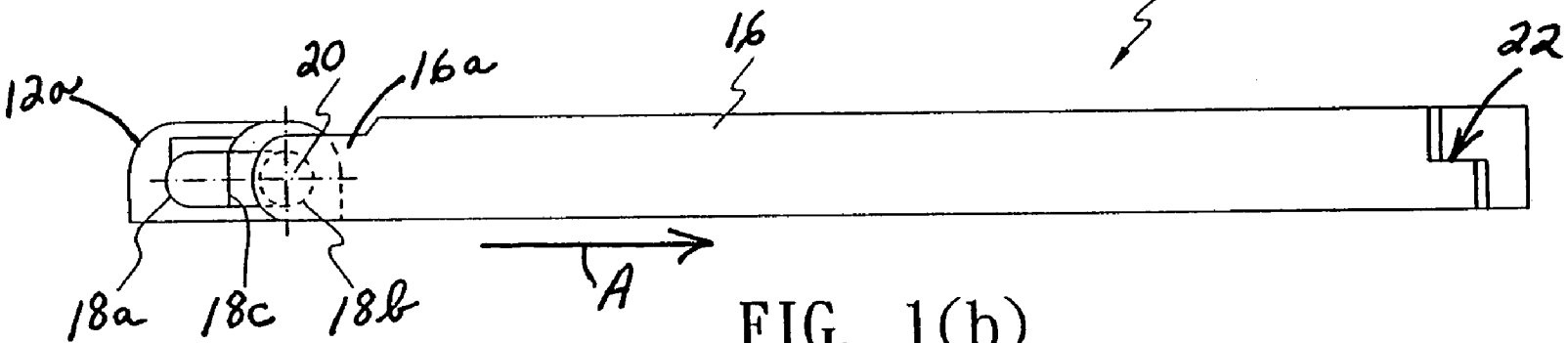
Figure 2:
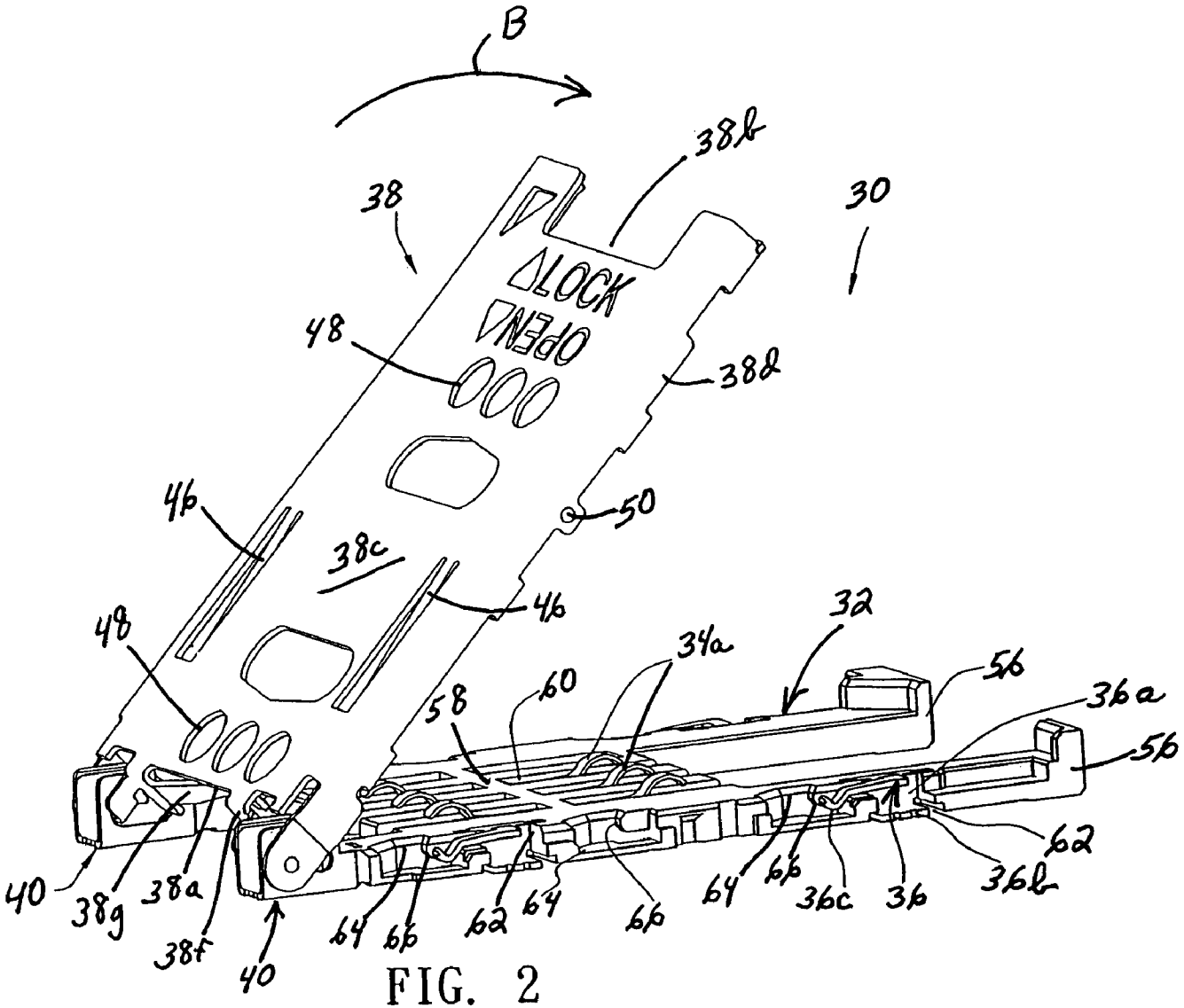
FIG. 2 is a perspective view of a memory card connector according to a first embodiment of the invention, with the cover pivoted upwardly from the housing.
Figure 3:
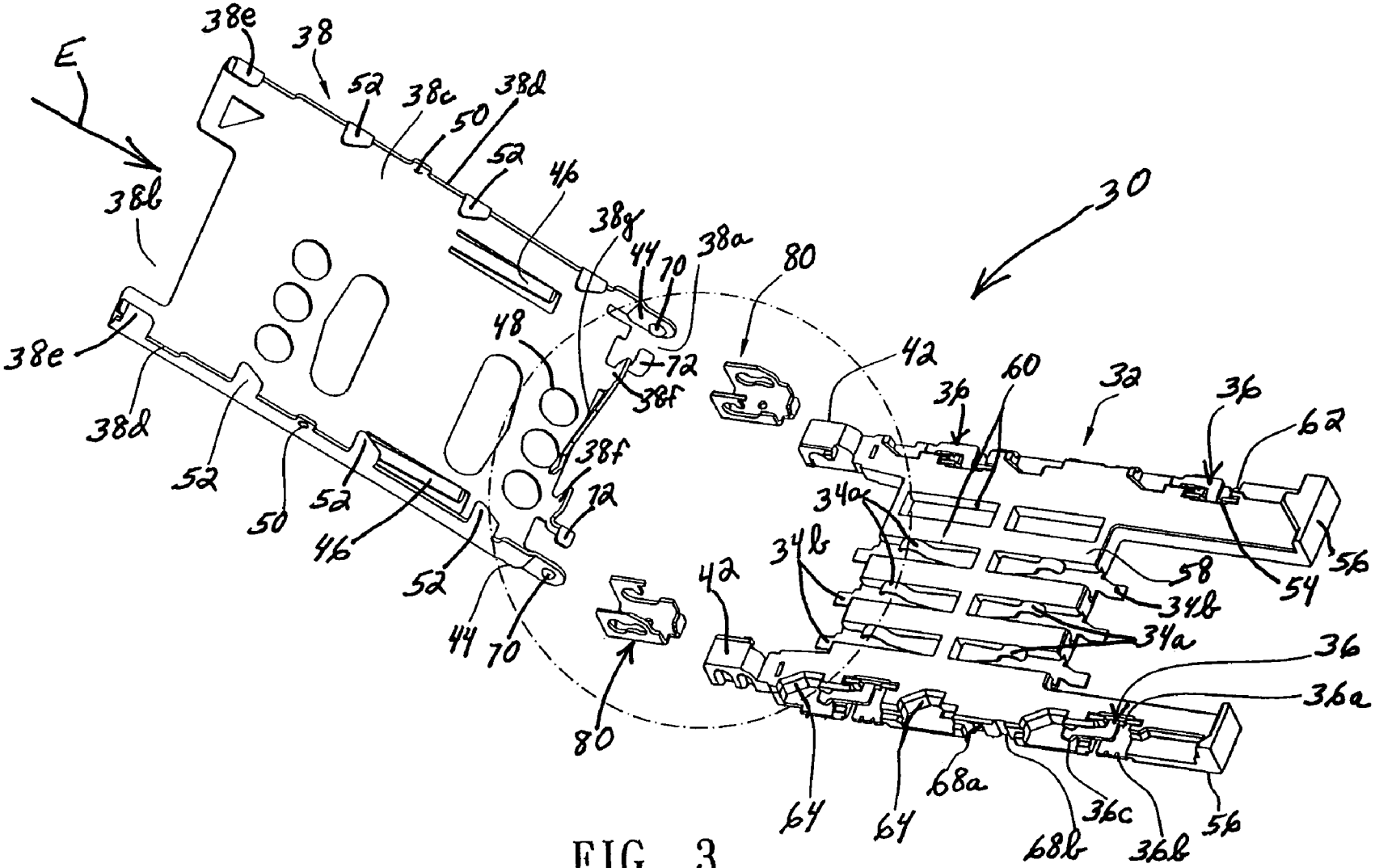
FIG. 3 is an exploded perspective view of the connector.
Figure 4:
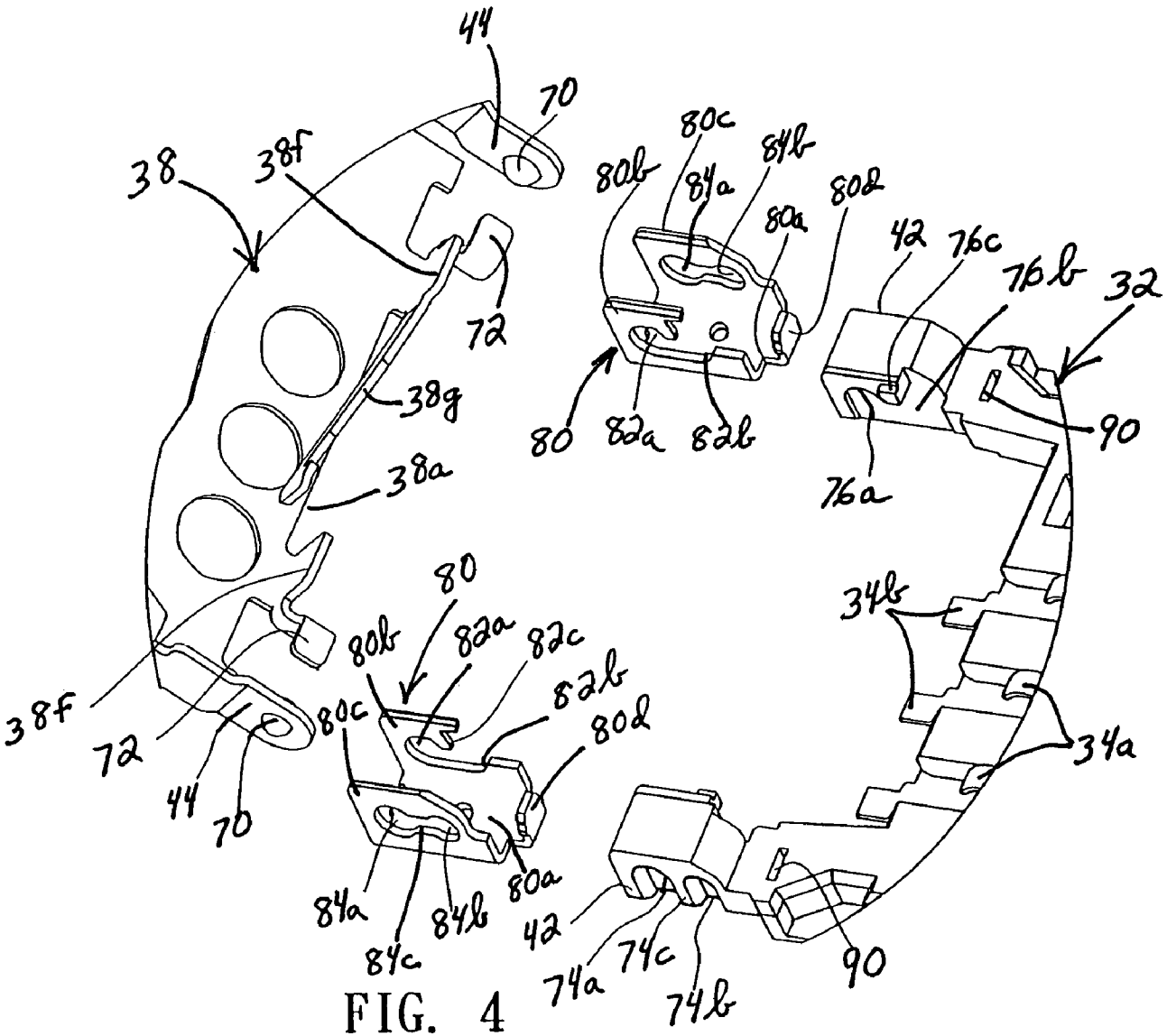
FIG. 4 is an enlarged depiction of the area encircled at "4" in FIG. 3.

Referring to the drawings in greater detail, and first to FIGS. 2–4, the invention is embodied in a SIM or memory card connector, generally designated 30, for receiving a SIM or memory card (not shown) having a plurality of conductive contacts. The connector includes an insulative body or housing, generally designated 32, which mounts a plurality of signal terminals, generally designated 34, and a plurality of ground terminals, generally designated 36. A cover, generally designated 38, is pivotally mounted to the housing by a pair of pivot means, generally designated 40 in FIG. 2. The housing may be molded of dielectric material such as plastic or the like. The cover is stamped and formed of sheet metal material.

Figure 5:
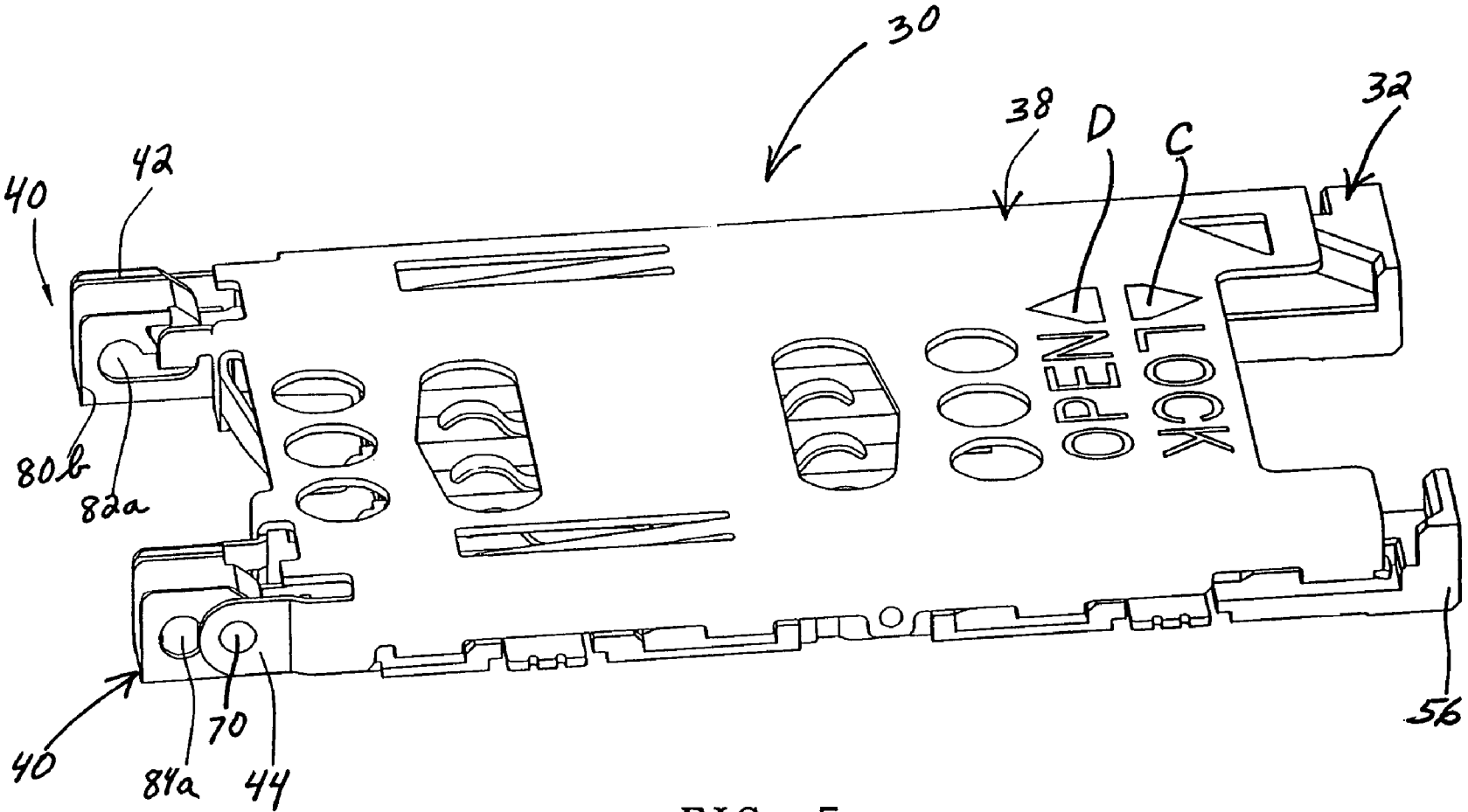
FIG. 5 is a perspective view of the connector, with the cover in its closed and latched position.

The pivot means 40 generally are provided between a pair of mounting portions or arms 42 at the rear of housing 32 and a pair of spring arms 44 at the pivot end of the stamped and formed sheet metal cover 38. Therefore, the cover is pivotally mounted to the housing for pivotal movement between an open position (FIG. 3) to allow a memory card to be mounted to the inside of the cover, through an intermediate position in the direction of arrow "B" as seen in FIG. 2, and to a closed position (not shown), bringing the contacts of the memory card into engagement with contact portions 34*a* of terminals 34 on housing 32. The pivot means 40 then allows the cover to slidably move from its closed position to a latched position shown in FIG. 5. The cover is slidably moved on the housing from its closed position to its latched position in the direction of arrow "C" (FIG. 5). The cover is slidably moved back to its closed and pivotal position in the direction of arrow "D".

Referring back to FIGS. 2–4, metal cover 38 includes a pivot end 38*a* and a memory card insertion end 38*b*. The cover includes a top wall 38*c* and a pair of side walls 38*d*. A flange 38*e* (FIG. 3) is bent inwardly from each side wall generally parallel to the top wall near insertion end 38*b*. A pair of bottom flanges 38*f* are bent generally perpendicular to top wall 38*c* at pivot end 38*a* of the cover. An angled, resilient arm 38*g* extends from one of the bottom flanges across the pivot end of the cover. Therefore, a receptacle means is provided at the underside of cover 38 by top wall 38*c*, side walls 38*d*, flanges 38*e* and bottom flanges 38*f*. A memory or SIM card is inserted into the receptacle means of the cover in the direction of arrow "E" (FIG. 3) until an end of the memory card engages resilient arm 38*g*. When the cover is pivoted to its closed and latched position shown in FIG. 5, a pair of spring arms 46 bias the memory card and, thereby, the contacts of the memory cards into engagement with terminals 34. A pair of spring arms 46 are stamped and formed out of top wall 30*c* of the cover and bias the memory card toward the terminals.

Other features of the cover include a plurality of holes 48 stamped out of top wall 38*c* of the cover to allow for visual inspection of solder connections of terminals 34 with a printed circuit board (not shown). An inwardly directed detent 50 is provided on each side wall 38*d* of the cover for purposes described hereinafter. Finally, a plurality of latching flanges 52 (FIG. 3) are bent inwardly from side walls 38*d*, again for purposes described hereinafter.

As best seen in FIG. 3, terminals 34 include contact portions 34*a* and solder tails portion 34*b*. The contact portions are engageable with the contacts of the memory card. The solder tail portions are surface connected, as by soldering, to appropriate circuit traces on the printed circuit board. Ground terminals 36 have fixing portions 36*a* (FIG. 3), solder pad portions 36*b* and flexible contact portions 36*c*. The fixing portions are inserted into mounting slots 54 in the housing to fix the ground terminals to the housing. Solder pad portions 36*b* are solder connected to appropriate ground traces on the printed circuit board. Contact portions 36*c* are engageable with some of the latching flanges 52 of cover 38 when the cover is slidably moved from its closed position to its latched position. Therefore, ground terminals 36 ground the cover to the printed circuit board.

Still referring to FIG. 3 in conjunction with FIGS. 2 and 4, housing 32 is generally H-shaped and may be a one-piece structure molded of dielectric material such as plastic or the like. The H-shape is formed by a pair of side legs 56 and a transverse body portion 58. Signal terminals 34 are mounted in slots 60 in the body portion. The sides of the housing are cut-out, as at 62, to accommodate solder pad portions 36*b* of ground terminals 36. Three notches 64 are formed along each side of the housing for accommodating latching flanges 52 of the cover when the cover is pivoted to its closed position. A latching shoulder 66 (FIG. 2) is formed within each notch. The contact portion 36*c* of each ground terminal 36 generally is in alignment with one of the latching shoulders 66 as can be seen in the right-hand notch as viewed in FIG. 2. Finally, a pair of detent grooves 68*a* and 68*b* are formed in each side of housing 32 for interengagement by detents 50 of the cover for purposes described hereinafter.

The invention herein centers around pivot means 40 as identified generally in FIG. 2, between housing 32 and cover 40. Specifically, and as shown in the enlarged depiction of FIG. 4, a pivot projection 70 is formed in each spring arm 44 of cover 38 to project inwardly toward the respective mounting portion 42 of the housing. As best seen in FIG. 4, each pivot projection 70 is generally conically shaped but somewhat rounded. In addition, a second pivot projection or tab 72 is formed at pivot end 38*a* of the cover and projects toward each pivot projection 70. In other words, two pairs of pivot projections are provided at the corners of the pivot end of the cover, each pair including an inwardly directed pivot projection 70 and an outwardly directed pivot tab 72.

The outside face of each mounting arm 42 of housing 32 is provided with a pair of recesses, including a pivot recess 74*a* and a latch recess 74*b* separated by a detent ridge 74*c*. The inside face of each mounting portion 42 is provided with a pivot recess 76*a* having an open mouth 76*b*, with a hook portion 76*c* therebetween. Pivot recess 76*a* at the inside of each mounting portion 42 is generally aligned, through the mounting portion, with pivot 74*a* at the outside of the mounting portion.

The invention contemplates the provision of a metal bracket, generally designated 80, for positioning about portions of each mounting arm 42 of the housing. Each mounting bracket is generally U-shaped in cross section and includes a bottom wall 80*a* and a pair of inside and outside side walls 80*b* and 80*c*, respectively. The mounting bracket may be stamped and formed of sheet metal material, and a fixing tab 80*d* is formed to project upwardly from an inner edge of bottom wall 80*a*.

Inside wall 80*b* of each metal bracket 80 is provided with a pivot socket 82*a* having an open mouth 82*b*, with a Y-shaped latch portion 82*c* therebetween. The outside wall 80*c* of each metal bracket 80 is provided with a pivot socket 84*a*, a latch socket 84*b* and a narrowed detent restriction 84*c* therebetween.

Metal brackets 80 are mounted about mounting portions 42 of housing 32 to the positions shown in FIG. 2, as follows. Each bracket is mounted to its respective mounting portion from the bottom thereof, by inserting fixing tab 80*d* into a through mounting hole 90 (FIG. 4) from the bottom of the hole. The bracket then is sort of pivoted or tilted upwardly until latch portion 82*c* of the bracket snaps over hook portion 76*c* on the housing. Bottom wall 80*a* and side walls 80*b* and 80*c* then become juxtaposed over the bottom face and side faces of mounting portion 42. When the bracket is so mounted, pivot socket 82*a* and open mouth 82*b* in inside wall 80*b* of the bracket become aligned with pivot recess 76*a* and open mouth 76*b* in the inside face of mounting portion 42. Pivot socket 84*a* and latch socket 84*b* in outside wall 80*c* of the bracket become aligned with pivot recess 74*a* and latch recess 74*b*, respectively, in the outside face of the mounting portion.

Cover 38 is assembled to housing 32 by positioning the cover generally as shown in FIG. 2. Pivot tabs 72 (FIG. 4) on the cover are directed into open mouths 82*b* of brackets 80 and open mouths 76*b* of mounting portions 42 of the housing and into pivot sockets 82*a* of the brackets. Simultaneously, pivot projections 70 on spring arms 44 are "snapped" into pivot sockets 84*a* of brackets 80 and pivot recesses 74*a* of mounting portions 42.

The cover then can be pivoted opposite the direction of arrow "B" in FIG. 2 to its open position generally at an angle somewhat similar to that of FIG. 3. The memory card then can be inserted into or mounted in the receptacle means of the cover.

With pivot projections 70 of the cover disposed within pivot sockets 84 of brackets 80, and with pivot tabs 72 of the cover disposed within pivot sockets 82*a* of the brackets, the cover then can be pivoted downwardly in the direction of arrow "B" (FIG. 2) from its open position to its closed position, bringing the contacts on the memory card into engagement with contact portions 34*a* of terminals 34.

After the cover is pivoted to its closed position, the cover then is slidably moved relative to housing 38 in the direction of arrow "C" (FIG. 5), to move the cover from its closed position to a latched position as shown in FIG. 5. During this movement, a number of things happen. First, pivot projections 70 move from pivot sockets 84*a* into latch sockets 84*b* of metal brackets 80. Simultaneously, pivot tabs 72 move from pivot sockets 82*a* into the open mouth areas 82*b* of the brackets. During this movement, pivot projections 70 "snap" over detent restrictions 84*c* of the brackets into latch sockets 84*b* to create a snapping action and render an audible and/or tactile indication of the cover moving from its closed position to its latched position. An additional clicking indication is given as detents 50 on the cover "snap" from detent grooves 68*a* to detent grooves 68*b* at the sides of the housing. Detents 84*c* and 50 combine to prevent unintentional sliding movement of the cover back from its latched position to its closed/pivotal position. Of course, the detents can be overcome by manually pushing the cover back in the direction of arrow "D" in FIG. 5.

Still further, when cover 38 is slidably moved relative to the housing from its closed position to its latched position shown in FIG. 5, latching flanges 52 of the cover slide under latching shoulders 66 within recesses 64 of the housing. This prevents the cover from being lifted off of the housing. Flanges 52 also slide into engagement with contact portions 36*c* of ground terminals 36 to ground the cover to the printed circuit board.

From the foregoing, it can be understood that metal brackets 80 provide a robust metal-to-metal pivotal engagement between metal cover 38 and plastic housing 32. Pivot recesses 74*a*, 74*b* and 76*a* at opposite sides of mounting portions 42 of the plastic housing primarily provide depth to accommodate pivot projections 70 and pivot tabs 72 of the metal cover. The primary engaging surfaces during closing and opening of the metal cover are between the metal brackets and the metal cover.

Figure 6:
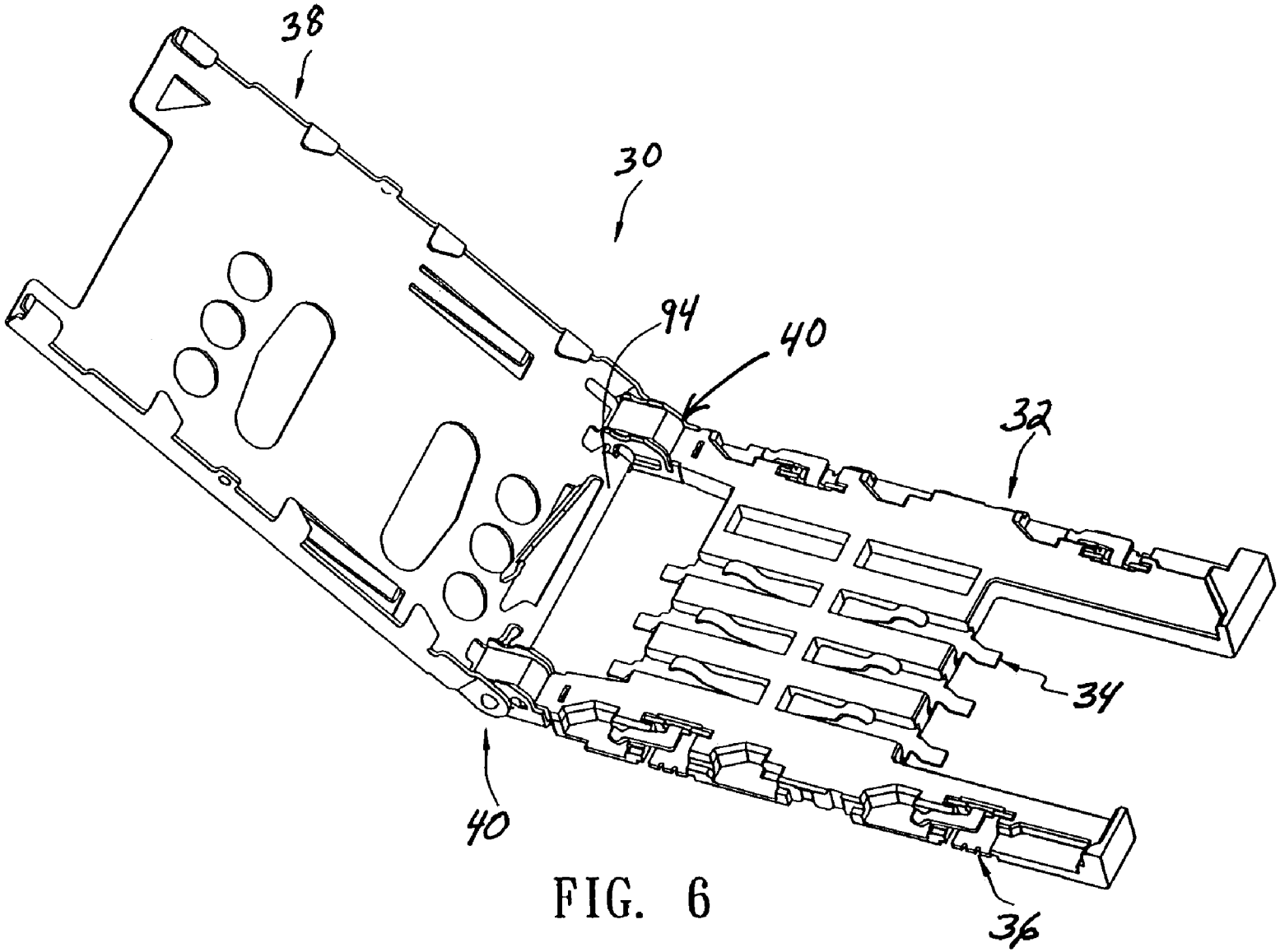
FIG. 6 is a perspective view of a memory card connector according to a second embodiment of the invention, with the cover in its open position.
Figure 7:
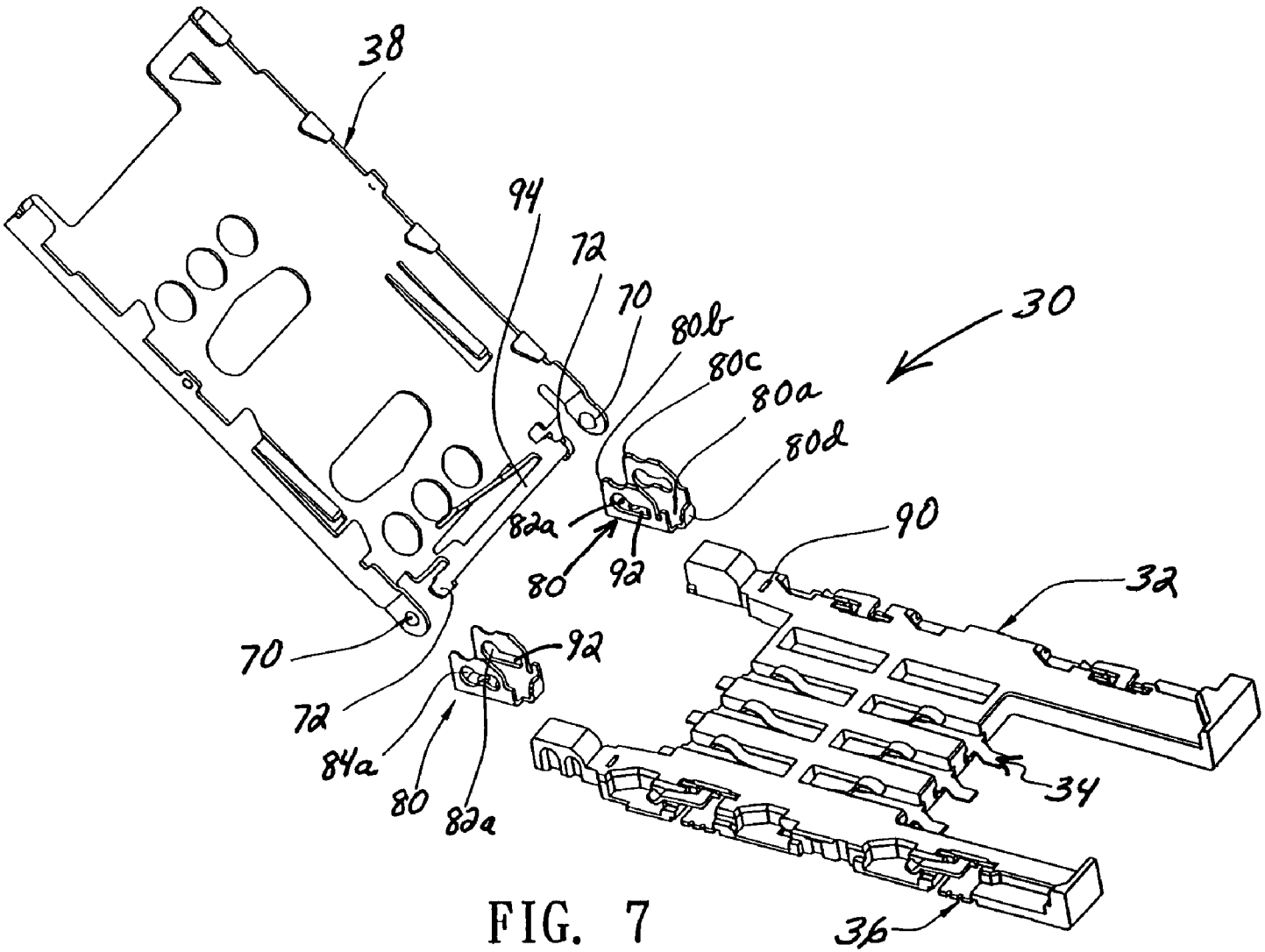
FIG. 7 is a view similar to that of FIG. 3, but of the second embodiment shown in FIG. 6.

FIGS. 6 and 7 show a second embodiment of the invention. Like reference numerals have been applied in FIGS. 6 and 7 corresponding to like components described above in relation to the first embodiment of FIGS. 1–5. Descriptions of those like components will not be repeated.

The main difference between the second embodiment of FIGS. 6 and 7 and the first embodiment of FIGS. 1–5 can best be seen by comparing FIG. 7 with FIG. 4. Specifically, it can be seen that the open mouth 82*b* in inside walls 80*b* of each bracket 80 has been eliminated from the first embodiment. Instead, a closed, elongated latch portion 92 has been provided and communicates with pivot socket 82*a*. Pivot projections 72 are joined by a link rod 94. When cover 38 is mounted to housing 32, pivot projections 70 of the cover are "snapped" into pivot sockets 84*a* in outside walls 80*c* of the brackets, as in the first embodiment. However, in the second embodiment, pivot tabs 72 also are snapped into pivot sockets 82*a* in inside walls 80*b* of the brackets due to the resiliency of the sheet metal material of the cover. When pivot tabs 72 slide into closed latch portions 92 as the cover is slidably moved to its latched position (FIG. 5), the closed, elongated nature of latch portions 92 provide further means to resist rotation of the cover upwardly away from its latched position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector for receiving a memory card having a plurality of conductive contacts, comprising:

an insulative housing mounting a plurality of conductive terminals;

a metal cover having receptacle means for receiving the memory card; and pivot means operatively associated between the cover and the housing to mount the cover for pivotal movement between an open position to allow the memory card to be received on the cover and a closed position bringing the contacts of the memory card into engagement with the terminals on the housing and including a cover mounting portion at one end of the housing, a pivot projection at one end of the cover, and a metal bracket about said mounting portion and including a pivot socket for receiving said pivot projection, wherein said housing includes a pair of said mounting portions at opposite sides of said one end thereof, the cover includes a pair of spring arms at said one end thereof juxtaposed alongside the pair of mounting portions and having pivot projections thereon, and including a pair of said metal brackets about the pair of mounting portions.

2. The memory card connector of claim 1 wherein said mounting portion comprises a mounting arm projecting from the housing, and the pivot projection is on a resilient pivot arm projecting from the cover.

3. The memory card connector of claim 1 wherein said mounting portion of the housing comprises a mounting arm projecting from the housing, the metal bracket includes a pair of side walls juxtaposed over opposite sides of the mounting arm with both side walls including a pivot socket, and the metal cover includes a pair of pivot projections for positioning in the pair of pivot sockets.

4. The memory card connector of claim 3 wherein at least one of said pivot sockets includes a pivot portion and a latch portion to allow the cover to slidably move from said closed position to a latched position.

5. The memory card connector of claim 3 wherein at least one of said pivot sockets includes a pivot portion and a latch portion to allow the cover to slidably move from said closed position to a latched position, the latch portion and the respective pivot projection being configured to prevent the cover from pivoting relative to the housing when the cover is in said latched position.

6. The memory card connector of claim 1 wherein said bracket is stamped and formed of sheet metal material and includes a wall having said pivot socket therein, the wall being juxtaposed over a side of the mounting portion of the housing, and the mounting portion having a pivot recess behind the pivot socket.

7. The memory card connector of claim 1 wherein said pivot socket in the metal bracket includes a pivot portion and a latch portion to allow the cover to slidably move from said closed position to a latched position.

8. The memory card connector of claim 1 wherein said pivot socket in the metal bracket includes a pivot portion and a latch portion to allow the cover to slidably move from said closed position to a latched position, the latch portion and the respective pivot projection being configured to prevent the cover from pivoting relative to the housing when the cover is in said latched position.

9. A memory card connector for receiving a memory card having a plurality of conductive contacts, comprising:

an insulative housing mounting a plurality of conductive terminals;

a metal cover having receptacle means for receiving the memory card; and pivot means operatively associated between the cover and the housing to mount the cover for pivotal movement between an open position to allow the memory card to be received on the cover and a closed position bringing the contacts of the memory card into engagement with the terminals on the housing and including a pair of mounting portions at one end of the housing at opposite sides thereof, a stamped and formed sheet metal bracket about at least portions of each mounting portion of the housing and including a pair of side walls juxtaposed over opposite sides of the mounting portion with both side walls including a pivot socket, and said metal cover including a pair of opposing pivot projections positionable within the pivot sockets in the pair of side walls of each metal bracket.

10. The memory card connector of claim 9 wherein at least one of said pivot sockets in each metal bracket includes a pivot portion and a latch portion to allow the cover to slidably move from said closed position to a latched position.

11. The memory card connector of claim 9 wherein at least one of said pivot sockets in each metal bracket includes a pivot portion and a latch portion to allow the cover to slidably move from said closed position to a latched position, the latch portion and the respective pivot projection being configured to prevent the cover from pivoting relative to the housing when the cover is in said latched position.

12. The memory card connector of claim 11 wherein said pivot portion of the pivot socket is round and the latch portion of the pivot socket is elongated.

13. The memory card connector of claim 9 wherein each mounting portion of the housing includes pivot recesses behind the pivot sockets of the respective metal bracket.

14. A memory card connector for receiving a memory card having a plurality of conductive contacts, comprising:

an insulative housing mounting a plurality of conductive terminals;

a metal cover having receptacle means for receiving the memory card; and pivot means operatively associated between the cover and the housing to mount the cover for pivotal movement between an open position to allow the memory card to be received on the cover and a closed position bringing the contacts of the memory card into engagement with the terminals on the housing and including a cover mounting portion at one end of the housing, a pivot projection at one end of the cover, and a metal bracket about said mounting portion and including a pivot socket for receiving said pivot projection, wherein said mounting portion of the housing comprises a mounting arm projecting from the housing, the metal bracket includes a pair of side walls juxtaposed over opposite sides of the mounting arm with both side walls including a pivot socket, and the metal cover includes a pair of pivot projections for positioning in the pair of pivot sockets.

15. A memory card connector for receiving a memory card having a plurality of conductive contacts, comprising:

an insulative housing mounting a plurality of conductive terminals;

a metal cover having receptacle means for receiving the memory card; and pivot means operatively associated between the cover and the housing to mount the cover for pivotal movement between an open position to allow the memory card to be received on the cover and a closed position bringing the contacts of the memory card into engagement with the terminals on the housing and including a cover mounting portion at one end of the housing, a pivot projection at one end of the cover, and a metal bracket about said mounting portion and including a pivot socket for receiving said pivot projection, wherein said bracket is stamped and formed of sheet metal material and includes a wall having said pivot socket therein, the wall being juxtaposed over a side of the mounting portion of the housing, and the mounting portion having a pivot recess behind the pivot socket.

16. A memory card connector for receiving a memory card having a plurality of conductive contacts, comprising:

an insulative housing mounting a plurality of conductive terminals;

a metal cover having receptacle means for receiving the memory card; and pivot means operatively associated between the cover and the housing to mount the cover for pivotal movement between an open position to allow the memory card to be received on the cover and a closed position bringing the contacts of the memory card into engagement with the terminals on the housing and including a cover mounting portion at one end of the housing, a pivot projection at one end of the cover, and a metal bracket about said mounting portion and including a pivot socket for receiving said pivot projection wherein said pivot socket in the metal bracket includes a pivot portion and a latch portion to allow the cover to slidably move from said closed position to a latched position, the latch portion and the respective pivot projection being configured to prevent the cover from pivoting relative to the housing when the cover is in said latched position.

* * * * *